US005224652A

United States Patent [19]

Kessler

[11] Patent Number: 5,224,652

[45] Date of Patent: Jul. 6, 1993

[54] LAWN WATER SHOWER

[75] Inventor: Brian D. Kessler, Youngstown, Ohio

[73] Assignee: Maui Toys, Inc., Youngstown, Ohio

[21] Appl. No.: 824,926

[22] Filed: Jan. 23, 1992

[51] Int. Cl.[5] ..... B05B 3/04

[52] U.S. Cl. ..... 239/211; 239/222.19; 239/276; 239/381; 239/498; 446/217; 446/219

[58] Field of Search ..... 239/211, 222.11, 22.17, 239/222.19, 276, 382, 498, DIG. 1, 381; 428/690; 446/217, 218, 219; 273/DIG. 24

[56] References Cited

U.S. PATENT DOCUMENTS

| | | | |
|---|---|---|---|
| 347,359 | 8/1886 | Lawson | 239/222.19 |
| 518,560 | 4/1894 | Black | 239/222.19 |
| 533,890 | 2/1895 | Hart | 239/498 |
| 587,662 | 8/1847 | Schulte | 239/222.17 |
| 608,646 | 8/1898 | Brown | 239/222.19 |
| 768,618 | 8/1904 | Neumeyer | 239/222.17 |
| 1,124,399 | 1/1915 | Earle | 239/222.19 |
| 1,307,514 | 6/1919 | Patterson | 239/222.19 |
| 1,481,327 | 1/1924 | Merseles | 239/11 |
| 2,564,400 | 8/1951 | Hall | 239/327 |
| 2,738,616 | 3/1956 | Windle | 446/219 |
| 2,928,610 | 3/1960 | Fenimore | 239/288.5 |
| 3,341,130 | 9/1967 | Weber | 239/327 |
| 3,518,788 | 7/1970 | Sides | 446/219 |
| 4,897,069 | 1/1990 | Overturf | 446/219 |
| 5,022,588 | 6/1991 | Haase | 239/222.17 |
| 5,079,046 | 1/1992 | Kessler | 428/4 |
| 5,092,807 | 3/1992 | Lew et al. | 446/159 |
| 5,092,809 | 3/1992 | Kessler | 446/217 |

*Primary Examiner*—Andres Kashnikow
*Assistant Examiner*—Karen B. Merritt
*Attorney, Agent, or Firm*—Browdy and Neimark

[57] ABSTRACT

A water shower device for spraying water to entertain and amuse children has a device at its bottom end for receiving water from a garden hose and for anchoring a hollow tube in the vertical direction. The hollow tube contains one or more crinkle plastic strips exhibiting neon edge glow, and at its upper end has a nozzle which carries a pinwheel, the pinwheel also displaying neon edge glow. The nozzle is a one-piece structure having downwardly ad inwardly directed struts which meet at a central nose and define openings through which the water spurts so as to impinge upon and drive the pinwheel, the pinwheel in turn disbursing the water droplets over 360°.

13 Claims, 1 Drawing Sheet

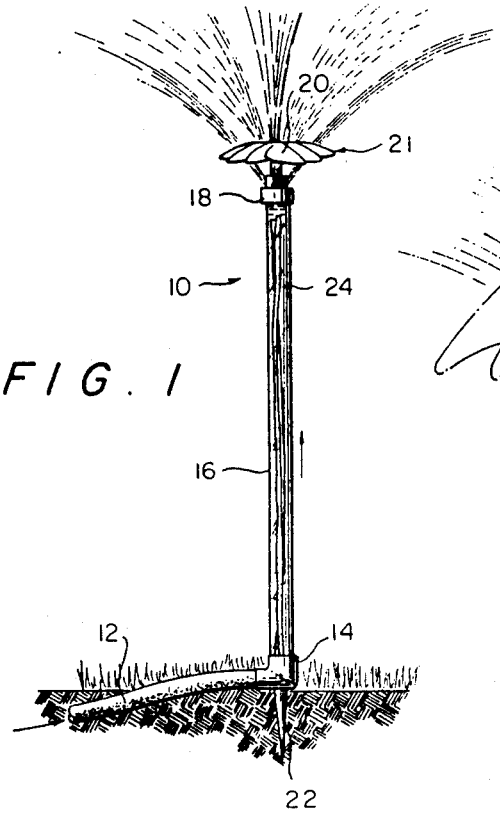
FIG. 1
FIG. 2
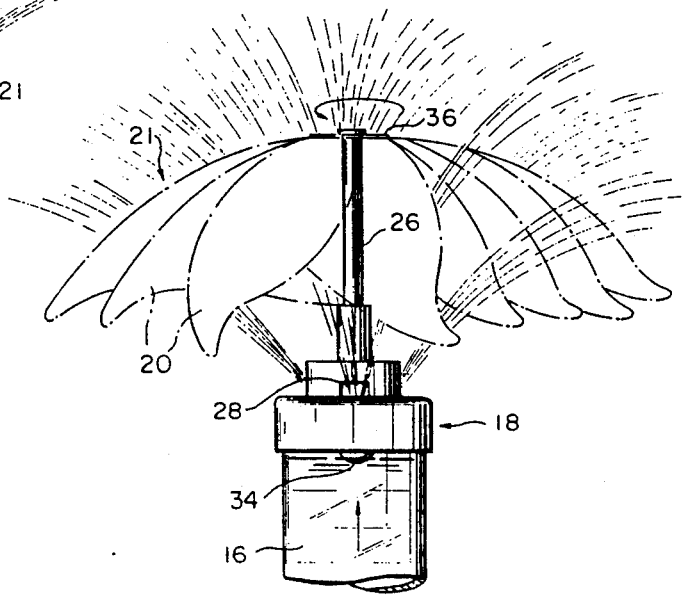
FIG. 4
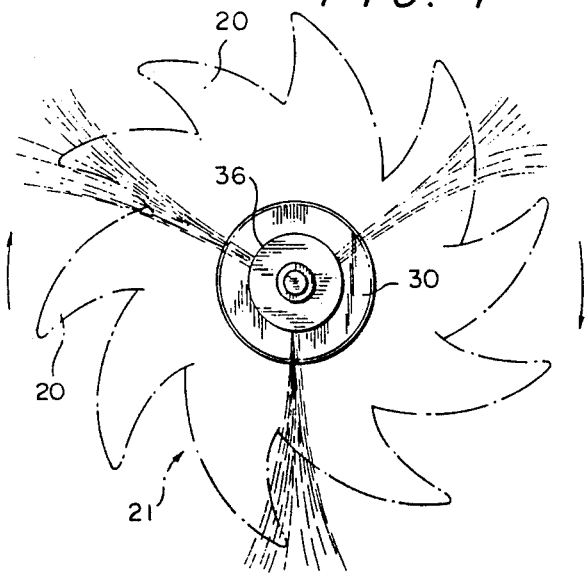
FIG. 3
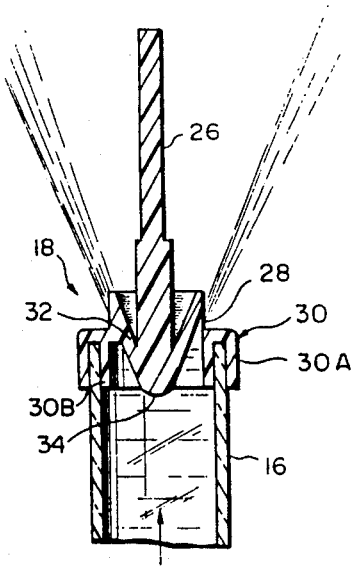
FIG. 5
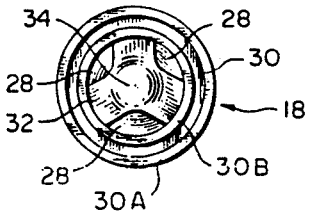

LAWN WATER SHOWER

CROSS REFERENCE TO RELATED APPLICATIONS

The present application is related to copending patent applications Ser. No. 07/628,550 filed Dec. 17, 1990, and 07/791,711 filed Nov. 14, 1991, and design application Ser. No. 07/637,890. The contents of these applications is hereby incorporated by reference.

FIELD OF THE INVENTION

The present invention relates to a children's play and entertainment device for spraying water and more particularly to the nozzle or plug at the distal end of a conduit delivering such water.

BACKGROUND TO THE INVENTION

A number of devices for spraying water such as lawn sprinklers are well known and commercially available. Many variations on this theme have been proposed to provide different distributions of liquid spray. Examples include U.S. Pat. Nos. 587,662, 608,646, 768,618, and 1,307,514 for lawn sprinklers and U.S. Pat. No. 1,481,327 for washing machines. U.S. Pat. No. 1,124,399 relates to a fuel oil burner having a fuel oil distributor. These and many others show using a variety of liquid distribution means for continually spraying the liquid such as having multiple outlets for the liquid and/or having deflecting vanes in the shape of fans or blades to further atomize and/or distribute the liquid.

Similar devices have been used for amusement as a water toy or to cool off on a hot day by showering an area with water. A recent example is U.S. Pat. No. 5,022,558 where deflected water forms an umbrella or fan shaped spray pattern.

SUMMARY OF THE INVENTION

It is an object of the present invention to provide an improved amusement device especially suitable for children's play which is especially attractive to children, easy to use, inexpensive and effective in uniformly and widely distributing a pleasant and satisfying shower of water.

It is another object of the invention to provide a water spraying device for simultaneous lawn watering and amusement.

A further object of the present invention is to provide an improved water distributing nozzle for such a water shower device.

The above and other objects are achieved according to the present invention by using a multiport nozzle which snugly fits inside and/or over the outside of a tube delivering water to this nozzle. A coaxial center stem is supported by multiple struts or the like which are angled so as to allow the liquid to be released at a fixed angle with respect to the axis. To further control the directional flow of fluid, the nozzle extends into the conduit delivering the water to divide the water stream before it reaches the end of the nozzle. An attractive pinwheel is connected to the stem immediately downstream of the nozzle to spread the spray of water emerging from the nozzle.

BRIEF DESCRIPTION OF THE DRAWING

The foregoing and other objectives, features and advantages of the present invention will be more readily understood from consideration of the following detailed description of the invention taken in conjunction with the accompanying drawings, wherein:

FIG. 1 is a side view of an embodiment of a lawn water shower device according to the present invention;

FIG. 2 is a partial side view, enlarged in comparison to FIG. 1, of a nozzle with a rotatable pinwheel attached to the central stem, the flow of liquid being shown;

FIG. 3 is a sectional view of a first preferred embodiment of a nozzle fitted on the end of a tube, in accordance with the present invention;

FIG. 4 is a partly schematic top view of the device of FIG. 2; and

FIG. 5 is a bottom view of the nozzle per se of FIG. 3 not connected to a tube.

DESCRIPTION OF THE PREFERRED EMBODIMENT

Referring to FIG. 1, a lawn water shower 10 distributes water entering through a hose 12 in the direction shown by the arrows. The lawn water shower 10 contains a junction 14 for tightly attaching the hose such as by the conventional interengagement of male and female screw threads, i.e. the downstream end of the hose 12 screws into the junction 14 in the usual way. The water then passes through a central cylindrical or polygonal tube 16 which is desirably transparent. Water then passes through a nozzle 18 and is sprayed into the air where it strikes the blades 20 of a pinwheel 21. The entire device 10 is vertically held by suitable means, preferably a stake 22 which can be driven into the ground for support, the stake 22 being preferably integrally molded of strong plastic (e.g. PVC) with the junction 14.

The hose 12 may be either rigid or flexible provided that it adequately delivers fluid to the shower; normally a conventional garden hose is used. The central tube is preferably made of a transparent plastic such as polyethylene, polystyrene, polypropylene, polyethylene terephthalate, polycarbonate or a blend of polyethylene and polypropylene. One or more plastic strips 24, crinkled transversely and having enhanced edge brightness such as that described in applicants' copending patent application, Ser. No. 07/791,711 filed Nov. 14, 1991, is placed within the tube 16 to provide an attractive and pleasing appearance with the strip edges and fold lines glowing brightly with a "neon" glow.

Referring to FIG. 2, one can see how the vanes or blades 20 of the pinwheel 21 rotate around a stem 26 in response to the spray of water being deflected by the pinwheel blades 20. The blades 20 are curved so that each blade has an inside concave surface and an outside convex surface. The nozzle 18 is snugly fitted on the upper end of the tube 16 to direct water out of openings 28 in the nozzle 18 radially Outwardly and upwardly so that the water passes through the path of the pinwheel and strikes the blades 20 of the pinwheel 21 on their concave surfaces causing the pinwheel to rotate. Desirably three openings 28 are provided in the nozzle 18 spaced at 120° from one another.

The pinwheel 21 of FIG. 2 may be made of clear, translucent or opaque brightly colored plastic, and it may be at least partially covered by a light reflective foil to present a flickering light effect to an onlooker. However, the pinwheel 21 is most preferably of the pinwheel shown in U.S. Pat. No. 5,092,809 in that its blades 20 are formed of transparent plastic containing a luminescent dye so as to provide the edges of the pinwheel with a "neon" glow which is brighter than the tint given to the major surfaces by the luminescent dye.

The configuration of the blades 20 of the pinwheel 21 may be conventional so that the pinwheel is rotated by the action of wind as well as water pressure. The stem 26 on which the blades 20 rotate should be made of stiff material and preferably an conveniently is injection molded unitary with the nozzle from PVC or the like.

Referring to FIG. 3, the nozzle 18 is snugly attached on the inside and the outside of the upper end of the transparent tube 16 with an inverted U shaped attachment means 30, which is a friction fit optionally augmented with an adhesive, thus forming a fluid tight fit. The fit should of course be sufficiently tight so that the nozzle will not be removed by the fluid pressure applied in the direction of the arrow. The U-shaped attachment means 30 includes an outer ring wall 30A and an inner ring wall 30B defining an annular gap therebetween. In addition to PVC, i.e. polyvinyl chloride, suitable materials from which to form the nozzle 18 include stiff rubber, polyethylene and polypropylene.

The central stem 26 of the nozzle 18 is attached to the outer attachment means 30 by a plurality of upwardly and outwardly directed struts 32. These struts 32 define therebetween the openings 28 through which the water spurts. The struts 32 join at their bottoms along the central axis of the nozzle 18 and the tube 16 in a nose 34. The fluid stream passing up the tube in the direction of the arrow is first divided by the nose 34 which projects into the tube below the attachment means 30. The water is divided and then squirts through the openings 28 which are radially distributed about the nozzle 18. The struts 32 and nose 34 are so formed that the fluid is channeled upwardly and outwardly toward the concave underside of the pinwheel blades 20.

As seen in FIG. 4, the blades 20 of the pinwheel 21 are curved so that when struck by ejected fluid an angular torque on the pinwheel 21 is produced. The pinwheel 21 is loosely fitted on stem 26 allowing it to spin thereabout as shown by the arrows in FIG. 4. A top plate or washer 36 keeps the pinwheel 21 from being pushed off the top of the stem 26. FIG. 4 is schematic in that the upper part of the attachment means 30 is shown, even though the pinwheel 21 is interposed between the washer 36 and the nozzle 18.

In FIG. 5 a bottom view of the nozzle 18 is shown. The three struts 32 are easily visible attaching the nose 34 to the attachment means 30 and defining therebetween the inclined openings 28. Any number of struts 32, preferably equally distributed, may be used and only one of the rings 30A or 30B are necessary for operability.

The foregoing description of the specific embodiments reveal the general nature of the invention so that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

All references mentioned in this application are incorporated by reference

What is claimed is:

1. A water shower device for amusement and play and for spraying water, comprising:

an elongated hollow tube for conveying water in an upward direction, wherein said tube is transparent and contains at least one crinkled strip of transparent plastic, said strip having major surfaces, edges and creases and containing a luminescent dye which causes the edges and creases of said strip to glow more brightly than the major surfaces of said strip;

means for feeding water to the interior bottom of said tube and means for fixing said tube in a vertical attitude;

a pinwheel disposed at an upper end of said vertical tube and adapted to spin about a vertical axis; and means for discharging water from said upper end of said tube in streams so as to impinge upon said pinwheel and cause said pinwheel to turn and at the same time scatter water in a generally uniform manner over an angle of 360°, said means comprising a water distributing nozzle affixed to the upper end of said tube below said pinwheel, said nozzle comprising an attachment means for fixedly attaching said nozzle to the upper end of said tube so that water pressure does not dislodge the nozzle from the tube, water guiding elements extending downwardly and inwardly from said attachment means and directed toward a central axis thereby defining circumferentially disposed openings, a nose at said central axis which divides the water flow and directs it toward the openings at a fixed angle with respect to the central axis, whereby water passing through said hollow tube is divided into a plurality of streams which strike said pinwheel and cause it to rotate.

2. The water shower device of claim 1 wherein said nose projects into said tube beyond said attachment means whereby the water flow is first contacted with said nose.

3. The water shower device of claim 1 wherein said attachment means comprises a downwardly depending ring wall which fits outside said tube.

4. The water shower device of claim 3 wherein said attachment means forms a friction bit and further comprises a second ring wall which fits inside said tube, said first and second walls in cross-section defining an inverted U.

5. The water shower device of claim 4 wherein said nose projects into said conduit beyond the attachment means whereby said fluid flow is first contacted with said nose.

6. The water shower device of claim 4, wherein said friction fit is augmented with adhesive.

7. The water shower device of claim 1 further comprising an integral central stem connected to said nose on an opposite side from the fluid flow, said pinwheel being mounted for spinning on said central stem.

8. A water shower device for amusement and play and for spraying water, comprising:

an elongated hollow tube for conveying water in an upward direction;

means for feeding water to the interior bottom of said tube and means for fixing said tube in a vertical attitude;

a pinwheel disposed at an upper end of said vertical tube and adapted to spin about a vertical axis, wherein said pinwheel is formed of transparent plastic, said pinwheel having major surfaces and edges and containing a luminescent dye which causes the edges of said pinwheel to glow more brightly than the major surfaces of said pinwheel; and means for discharging water from said upper end of said tube in streams so as to impinge upon said pinwheel and cause said pinwheel to turn and at the same time scatter water in a generally uniform manner over an angle of 360°, said means comprising a water distributing nozzle affixed to the upper end of said tube below said pinwheel, said nozzle comprising an attachment means for fixedly attaching said nozzle to the upper end of said tube so that water pressure does not dislodge the nozzle from the tube, water guiding elements extending downwardly and inwardly from said attachment means and directed toward a central axis thereby defining circumferentially disposed openings, a nose at said central axis which divides the water flow and directs it toward the openings at a fixed angle with respect to the central axis, whereby water passing through said hollow tube is divided into a plurality of streams which strike said pinwheel and cause it to rotate.

9. The water shower device of claim 8 wherein said tube is transparent and contains at least one decorative crinkled plastic strip with enhanced edge brightness.

10. The water shower device of claim 8 wherein said attachment means comprises a downwardly depending ring wall which fits outside said tube.

11. The water shower device of claim 10 wherein said attachment means forms a friction fit and further comprises a second ring wall which fits inside said tube, said first and second walls in cross-section defining an inverted U.

12. The water shower device of claim 11 wherein said nose projects into said conduit beyond the attachment means whereby said fluid flow is first contacted with said nose.

13. The water shower device of claim 8 further comprising an integral central stem connected to said nose on an opposite side from the fluid flow, said pinwheel being mounted for spinning on said central stem.

* * * * *